United States Patent [19]

Audeh

[11] Patent Number: 4,880,527

[45] Date of Patent: Nov. 14, 1989

[54] PROCESS FOR REMOVING RESIDUAL MERCURY FROM LIQUID HYDROCARBONS WITH AQUEOUS POLYSULFIDE SOLUTIONS

[75] Inventor: Costandi A. Audeh, Princeton, N.J.

[73] Assignee: Mobil Oil Corporation, New York, N.Y.

[21] Appl. No.: 108,598

[22] Filed: Oct. 15, 1987

[51] Int. Cl.[4] ..... C10G 17/04

[52] U.S. Cl. ..... 208/251 R; 208/284; 208/293; 208/253; 210/702

[58] Field of Search ..... 208/251 R, 284, 287, 208/293, 253; 585/856; 55/59, 74; 423/230; 210/702, 712, 717, 719, 723

[56] References Cited

U.S. PATENT DOCUMENTS

| | | | |
|---|---|---|---|
| 4,147,626 | 4/1979 | Findlay et al. | 210/724 |
| 4,354,942 | 10/1982 | Kaczur et al. | 210/712 |
| 4,474,896 | 10/1984 | Chao | 502/210 |
| 4,614,592 | 9/1986 | Googin et al. | 210/688 |
| 4,619,744 | 10/1986 | Horton | 423/101 X |

*Primary Examiner*—Glenn Caldarola

*Attorney, Agent, or Firm*—Alexander J. McKillop; Charles J. Speciale

[57] ABSTRACT

Liquid hydrocarbons (natural gas condensate) are depleted of contaminating mercury by contacting them with a solution of an alkali polysulfide.

7 Claims, No Drawings

PROCESS FOR REMOVING RESIDUAL MERCURY FROM LIQUID HYDROCARBONS WITH AQUEOUS POLYSULFIDE SOLUTIONS

NATURE OF THE INVENTION

This invention relates to a method for purifying and removing trace amounts of mercury from liquid hydrocarbons, particularly natural gas condensate.

PRIOR ART

Trace quantities of mercury are known to exist in natural gas and natural gas condensate, but the significance of these trace quantities has not been recognized until recently. The mercury detected in the produced gas and the associated condensate is now known not to result from well drilling or well completion operations and does not result by accident. The mercury is produced in association with the gas and the condensate and is thought to originate from geologic deposits in which the natural gas occurs. Even in trace quantities however, mercury is an undesirable component. The processing of natural gas in LNG plants requires at some location in the system contact with equipment made primarily of aluminum. This is particularly true after the stages of processing where the gas is treated to remove carbon dioxide and hydrogen sulfide and then is chilled or cooled in aluminum-constructed heat exchangers. Because large volumes of gas must flow through the aluminum heat exchangers they are of massive size and represent a capital investment of several million dollars.

Damage to these exchangers is to be avoided if at all possible. One threat of damage comes from the mercury present in the gas flowing through the heat exchangers. Although the concentration of mercury appears low, its effect is cumulative as it amalgamates with the aluminum. The result is damage to the system such as corrosion cracking leading to equipment failure. Repair is correspondingly difficult because of damage to the welded seams of the aluminum. Replacement of the heat exchangers in an LNG plant represents a large expenditure. The problem of mercury in natural gas is discussed further in U.S. Pat. No. 4,094,777 and French Pat. No. 2,310,795, both of which are incorporated herein by reference.

Several methods have been proposed for absorbing mercury from natural gas. For example, J. E. Leeper in Hydrocarbon Processing, Volume 59, November, 1980, pages 237–240, describes a procedure wherein natural gas is contacted with a fixed bed of copper sulfide on an alumina-silica support to remove the mercury present. The absorbent is regenerated by purging it with gas heated to a temperature of 200°–500° C. Another commercial process is based on contacting the mercury contaminated gas with sulfur supported on activated carbon. According to the Leeper article, the sulfur impregnated activated charcoal process is regarded as the best system for treating a gas stream, particularly one free of heavy hydrocarbons. The reference, Hydrocarbon Processing, Volume 59, November, 1980, pages 237–240, is incorporated herein by reference.

U.S. Pat. No. 4,474,896 discloses the removal of mercury from liquids and gases utilizing a support material containing sulfide species to be contacted with the liquid or gas under treatment.

The presence of mercury contamination in natural gas in turn leads to the formation of mercury-contaminated gas condensate and associated liquid hydrocarbons. Accordingly a primary object of this invention is to provide an improved process for removing trace quantities of mercury present in a hydrocarbon condensate, particularly petroleum gas condensate.

SUMMARY OF THE INVENTION

Briefly stated, this invention comprises reducing the concentration of mercury in a hydrocarbon gas condensate by first contacting the liquid condensate with a solution of an alkali polysulfide and subsequently recovering a liquid hydrocarbon product substantially depleted of mercury.

DESCRIPTION OF THE INVENTION

As stated above, the essence of this invention lies in treating the liquid hydrocarbon (natural gas condensate) containing mercury by contacting it with a solution of an alkali polysulfide. Preferably the alkali polysulfide is sodium polysulfide and the concentration of sulfur in the polysulfide is between 0.1 and 25%. Natural gas condensate can be contacted with the aqueous polysulfide solution in several different ways in batchwise or continuous processes. In one method the condensate is introduced into the bottom of a packed column and the aqueous solution of polysulfide is introduced into the top of the column in countercurrent flow so that the condensate rising through the column thoroughly contacts the aqueous polysulfide solution. The effluent liquid condensate is recovered and further processed to remove any moisture or other material present in the liquid condensate. The temperature at which this process is carried out can be ambient or room temperature, i.e. about 70° F. or higher and the pressure can be atomspheric pressure or higher.

When the alkali polysulfide is sodium polysulfide the aqueous solution should contain between 5.0 and 350.0 grams of sodium polysulfide per liter of water. The liquid hydrocarbons treated according to this invention ordinarily will have an average molecular weight of between 110 and 130.

The polysulfide compound can be a polysulfide of a metal selected from the group consisting of sodium, potassium lithium, rubidium, cesium, magnesium and calcium and the concentration of sulfur in the polysulfide solution between 0.1 and 25 percent by weight.

The liquid hydrocarbon treated according to the process of this invention subsequently is allowed to separate into a hydrocarbon phase and an aqueous phrase. The two phases are then separated and the liquid hydrocarbon phase can be further treated to remove entrained water, etc.

EXAMPLES

In the following examples pentane is used to simulate a petroleum gas condensate because pentane is a major component of gas condensate.

Example 1

One hundred (100) cc. of pentane containing 13 ppb of mercury were mixed with about ½ cc. of an aqueous solution of sodium polysulfide containing 22.2% sulfur and shaken vigorously. After the aqueous layer had settled the treated pentane was decanted, washed with water and dried over molecular sieves. The mercury content of the treated and dried pentane was less than 0.01 ppb.

Example 2

One hundred (100) cc. of pentane containing 0.53 ppb mercury were treated as described in Example 1. Similarly the mercury content of the treated and dried pentane was less than 0.01 ppb.

Example 3

One hundred (100) cc. of pentane containing 13 ppb mercury were washed with water and dried over molecular sieves. The mercury content of the treated dry pentane was determined. The mercury content did not change, but remained at 13 ppb.

Example 3 demonstrates that washing pentane with water and dryng it over molecular sieves does not reduce the mercury content of pentane.

Example 4

Example 1 was repeated using an aqueous solution of sodium polysulfide containing 3.5% sulfur. The amount of solution used was 5 cc. Similarly the mercury content of the treated and dried pentane was determined to be less than 0.01 ppb.

The above examples are not intended to limit the scope of the invention but are presented to illustrate the efficiency of the polysulfide in removing mercury from a liquid hydrocarbon. Those skilled in the art will readily recognize that the use of these solutions can be extended to lower or higher concentrations than those given in the above examples. It will, however, be necessary to make sure that solutions containing low sulfur concentrations be given sufficient contact with the hydrocarbon to bring about reaction with mercury.

I claim:

1. A process for treating a liquid hydrocarbon containing mercury comprising:

(a) contacting said liquid hydrocarbon with an aqueous solution of an alkali polysulfide; and (b) separating a liquid hydrocarbon phase containing a substantially reduced concentration of mercury.

2. The process of claim 1 wherein the liquid hydrocarbon to be treated is natural gas condensate.

3. The process of claim 1 wherein the liquid hydrocarbon to be treated is pentane.

4. The process of claim 1 wherein the aqueous solution of alkali polysulfide contains between about 0.1 and about 25 percent by weight of sulfur.

5. The process of claim 1 wherein the alkali polysulfide is a polysulfide of an alkali metal selected from the group consisting of sodium, potassium, rubidium, cesium, lithium, magnesium, and calcium.

6. The process of claim 1 wherein the alkali polysulfide is sodium polysulfide.

7. The process of claim 1 wherein the sodium polysulfide composition contains between about 0.1 and about 25 percent sulfur.

* * * * *